US008640484B2

(12) United States Patent
Jang et al.

(10) Patent No.: US 8,640,484 B2
(45) Date of Patent: Feb. 4, 2014

(54) REFRIGERATOR WITH A DISPENSER

(75) Inventors: Heon-jae Jang, Changwon-shi (KR); Seung-beom Chae, Gangneung-shi (KR); Il-wook Joung, Gimhae-shi (KR); Sang-ho Park, Gimhae-shi (KR); Yong-chul Kwon, Changwon-shi (KR); Hyeon-jin Kim, Masan-shi (KR)

(73) Assignee: LG Electronics Inc., Seoul (KR)

( * ) Notice: Subject to any disclaimer, the term of this patent is extended or adjusted under 35 U.S.C. 154(b) by 811 days.

(21) Appl. No.: 12/000,321

(22) Filed: Dec. 11, 2007

(65) Prior Publication Data

US 2008/0178627 A1 Jul. 31, 2008

(30) Foreign Application Priority Data

Dec. 11, 2006 (KR) ..... PCT/KR2006/005389

(51) Int. Cl.
*F25D 3/00* (2006.01)

(52) U.S. Cl.
USPC ..... 62/389; 62/390

(58) Field of Classification Search
USPC ..... 62/389–400
See application file for complete search history.

(56) References Cited

U.S. PATENT DOCUMENTS

| | | | | |
|---|---|---|---|---|
| 4,543,800 | A | 10/1985 | Mawby et al. | |
| 4,800,935 | A | 1/1989 | Buchser et al. | |
| 4,807,086 | A * | 2/1989 | Chambliss | 361/212 |
| 5,033,273 | A | 7/1991 | Buchser | |
| 5,405,052 | A | 4/1995 | Sawyer, III | |
| 5,526,854 | A | 6/1996 | Unger | |
| 5,766,453 | A * | 6/1998 | Morellato et al. | 210/143 |
| 6,135,173 | A | 10/2000 | Lee | |
| 6,651,449 | B2 | 11/2003 | Heims | |
| 6,679,082 | B1 | 1/2004 | Tunzi | |
| 6,964,177 | B2 | 11/2005 | Lee et al. | |
| 7,007,500 | B2 | 3/2006 | Lee | |
| 7,201,005 | B2 * | 4/2007 | Voglewede et al. | 62/126 |

(Continued)

FOREIGN PATENT DOCUMENTS

| | | |
|---|---|---|
| CN | 1659413 A | 8/2005 |
| CN | 1683874 A | 10/2005 |

(Continued)

OTHER PUBLICATIONS

Korean Office Action issued in Korean Application No. 10-2008-7031189, dated May 18, 2009, 9 pages.

(Continued)

*Primary Examiner* — Cassey D Bauer
(74) *Attorney, Agent, or Firm* — Fish & Richardson P.C.

(57) ABSTRACT

A refrigerator dispenser includes a dispenser assembly housing that is accommodated by a door surface hole having a sizing ratio that is defined by dividing a height with a width of the door surface hole. The dispenser assembly housing is configured to define a dispenser assembly cavity in at least a portion of the dispenser assembly housing. The dispenser assembly cavity has an opening at a front surface of the dispenser assembly housing and has a sizing ratio that is defined by dividing a height with a width of the dispenser assembly cavity along the opening. A control panel extends along at least one of a horizontal and vertical dimension of the front surface of the dispenser assembly housing proximate to the opening. The sizing ratio of the door surface hole is different than the sizing ratio of the dispenser assembly cavity.

19 Claims, 20 Drawing Sheets

(56) References Cited

U.S. PATENT DOCUMENTS

| | | | | |
|---|---|---|---|---|
| 7,455,085 | B2 * | 11/2008 | Voglewede et al. | 141/360 |
| 7,493,774 | B2 | 2/2009 | Ferragut | |
| 2003/0019236 | A1 | 1/2003 | Heims | |
| 2004/0183414 | A1 | 9/2004 | Kwon | |
| 2004/0187516 | A1 | 9/2004 | Lee | |
| 2005/0072178 | A1 * | 4/2005 | Park et al. | 62/389 |
| 2005/0268638 | A1 | 12/2005 | Voglewede et al. | |
| 2006/0065008 | A1 * | 3/2006 | Park | 62/344 |
| 2006/0196214 | A1 * | 9/2006 | Lee et al. | 62/344 |
| 2006/0201190 | A1 | 9/2006 | Bowen et al. | |
| 2006/0201194 | A1 * | 9/2006 | Bowen et al. | 62/344 |

FOREIGN PATENT DOCUMENTS

| | | |
|---|---|---|
| CN | 1707205 A | 12/2005 |
| EP | 1 605 219 | 12/2005 |
| KR | 10-2004-0013820 | 2/2004 |
| KR | 10-2006-0104357 | 10/2006 |
| WO | 03/102481 | 12/2003 |

OTHER PUBLICATIONS

Supplementary Search Report issued in European Application No. EP 06 82 4095, mailed Jan. 12, 2010, 6 pages.

Search Report issued in European Application No. EP 09 01 1469, mailed Jan. 20, 2010, 5 pages.

Chinese Office Action issued in Chinese Patent Application No. 200680056414X, mailed Feb. 5, 2010, 8 pages.

Chinese Office Action dated Oct. 18, 2010 for Chinese Patent Application No. 200910171361.1, in English language, 8 pages.

U.S. Office Action dated Apr. 10, 2013 for U.S. Appl. No. 12/966,129, 16 pages.

Non-Final Office Action issued in U.S. Appl. No. 12/000,324, mailed Jun. 15, 2010, 17 pages.

Chinese Office Action issued in Application No. 200910171363.0, dated Sep. 14, 2010, 13 pages.

* cited by examiner

REFRIGERATOR WITH A DISPENSER

TECHNICAL FIELD

This disclosure relates to a refrigerator including a dispenser.

DESCRIPTION OF RELATED ART

FIG. 1 illustrates an example of a refrigerator including a dispenser. In this example, the refrigerator 100 includes a dispenser 120 positioned on a freezing chamber door 110. The dispenser 120 has an outlet region 130 that includes operation levers 140 and a support 150.

FIG. 2 illustrates an example of a refrigerator including a dispenser. In this example, the refrigerator 200 includes a dispenser 220 positioned on a refrigerating chamber door 210.

FIG. 3 illustrates another example of a refrigerator including a dispenser. In this example, the refrigerator 300 includes a freezing chamber 310 and a refrigerating chamber 320. An ice maker 330 is installed in the freezing chamber 310 and a dispenser 350 is installed on a freezing chamber door 340. A flow path 360 is connected to an external water supply source (not shown) and configured to supply water to the ice maker 330 and the dispenser 350. A first valve 370, a filter 380, and a second valve 390 may be provided at various points along the flow path 360. The first valve 370 may be configured to control water supply from the external water supply source to the refrigerator 300, the filter 380 may be configured to filter water, and the second valve 390 may be configured to control water supply to the ice maker 330 and the dispenser 350. The first valve 370 and the second valve 390 may be controlled by a control unit (not shown) of the refrigerator 300. The flow path 360 includes a flow path 361 configured to supply water to the dispenser 350. Water flowing through the flow path 361 may be cooled by heat exchange with the freezing chamber 310 and discharged through an outlet 362 of the flow path 361 to an outlet region 351 of the dispenser 350.

FIG. 4 illustrates another example of a refrigerator including a dispenser. In this example, the refrigerator 400 includes an operation panel 410 and an ice maker 420. The operation panel 410 includes a display 411 and at least one button 412. The ice maker 420 may be connected to an outlet region 451 through a passage 421. When a user selects cold water by activating the button 412 and pressing an operation lever 452, water is discharged through an outlet 462. When the user selects cubed ice or crushed ice by activating the button 412 and pressing the operation lever 452, cubed ice or crushed ice is discharged through an outlet 422.

FIG. 5 illustrates a refrigerator including a dispenser. The refrigerator 500 includes a pad type button 510 instead of an operation lever. The user selects cold water or ice by using the operation panel 520, and presses the button 510 with a cup (not shown) to obtain cold water or ice.

FIGS. 6 and 7 illustrate an example of a dispenser structure for a refrigerator. The dispenser structure includes an ice bank 610 connected to the dispenser structure configured to store ice. The ice bank 610 includes transfer screws 611 and 612 configured to transfer ice, and cutters 613 and 614 positioned at a front portion of the transfer screws 611 and 612 and configured to cut ice into different sizes. The cut ice may be discharged to an outlet region 630 through a passage 620.

FIGS. 8 and 9 illustrate an example of a dispenser for a refrigerator. The dispenser includes an outlet region 830 and a cold water supply unit 820 that has a cold water outlet 810. As shown in FIG. 8, the cold water outlet 810 of the cold water supply unit 820 is positioned in the outlet region 830 in the dispenser 800. As shown in FIG. 9, the cold water outlet 810 of the cold water supply unit 820 has been slidably extended such that the outlet of the cold water outlet 810 is positioned outside of the outlet region 830 in the dispenser 800. In this example, even if a container 840 configured to contain cold water is too big to enter the outlet region 830, cold water may be supplied to the container 840.

SUMMARY

In one aspect, a refrigerator dispenser includes a door surface configured to define a door surface hole having a sizing ratio that is defined by dividing a height with a width of the door surface hole. The refrigerator dispenser also includes a dispenser assembly housing that is accommodated by the door surface hole and configured to define a dispenser assembly cavity in at least a portion of the dispenser assembly housing. The dispenser assembly cavity having an opening at a front surface of the dispenser assembly housing to enable insertion of a container into the dispenser assembly cavity and having a sizing ratio that is defined by dividing a height with a width of the dispenser assembly cavity along the opening at the front surface of the dispenser assembly housing. A control panel is positioned within the dispenser assembly housing and extends along at least one of a horizontal and vertical dimension of the front surface of the dispenser assembly housing proximate to the opening at the front surface of the dispenser assembly housing. The sizing ratio of the door surface hole is different than the sizing ratio of the dispenser assembly cavity.

Implementations may include one or more of the following features. For example, the control panel may extend along the horizontal dimension of the front surface of the dispenser assembly housing. The control panel may extend along an entire horizontal dimension of the front surface of the dispenser assembly housing and only partially along a vertical dimension of the front surface of the dispenser assembly housing such that the dispenser assembly cavity may be positioned above or below the control panel. The dispenser assembly cavity may be positioned above the control panel or the dispenser assembly cavity may be positioned below the control panel. The sizing ratio of the door surface hole may be greater than the sizing ratio of the dispenser assembly cavity and a ratio defined by dividing the height of the dispenser assembly cavity with the height of the door surface hole may be less than a ratio defined by dividing the width of the dispenser assembly cavity with the width of the door surface hole.

In some implementations, the control panel may extend along the vertical dimension of the front surface of the dispenser assembly housing. In these implementations, the control panel may extend along an entire vertical dimension of the front surface of the dispenser assembly housing and only partially along a horizontal dimension of the front surface of the dispenser assembly housing such that the dispenser assembly cavity may be positioned adjacent to the control panel. The sizing ratio of the door surface hole may be less than the sizing ratio of the dispenser assembly cavity, and a ratio defined by dividing the height of the dispenser assembly cavity with the height of the door surface hole may be greater than a ratio defined by dividing the width of the dispenser assembly cavity with the width of the door surface hole.

In some examples, a liquid dispensing chute may be positioned within the dispenser assembly cavity, and the control panel may include a liquid dispensing actuator configured to receive input to inspire dispensing of liquid through the liquid dispensing chute. In these examples, the liquid dispensing actuator included in the control panel may be a first liquid dispensing actuator, and the refrigerator dispenser may include a second liquid dispensing actuator positioned within the dispenser assembly cavity. Both the first liquid dispensing actuator and the second liquid dispensing actuator may be configured to receive input to inspire dispensing of liquid through the liquid dispensing chute.

In some implementations, an ice dispensing chute may be positioned within the dispenser assembly cavity, and the control panel may include an ice dispensing actuator configured to receive input to inspire dispensing of ice through the ice dispensing chute. The ice dispensing actuator included in the control panel may be a first ice dispensing actuator, and the refrigerator dispenser may include a second ice dispensing actuator positioned within the dispenser assembly cavity. Both the first ice dispensing actuator and the second ice dispensing actuator may be configured to receive input to inspire dispensing of ice through the ice dispensing chute.

An ice dispensing chute may be positioned within the dispenser assembly cavity, and the control panel may include an ice selection actuator configured to receive input to select whether ice dispensed through the ice dispensing chute is cubed ice or crushed ice. The control panel may include a display configured to render a user interface indicating operational status of the refrigerator dispenser. The control panel may include multiple input buttons and at least one of the buttons receives input to inspire performance of a function based on the user interface rendered on the display of the control panel.

In another aspect, a refrigerator dispenser includes a door surface configured to define a door surface hole having a first height and a first width, and a dispenser assembly housing that is accommodated by the door surface hole and configured to define a dispenser assembly cavity in at least a portion of the dispenser assembly housing. The dispenser assembly cavity has an opening at a front surface of the dispenser assembly housing to enable insertion of a container into the dispenser assembly cavity and has a second height and a second width. The second width is less than the first width. A control panel is positioned within the dispenser assembly housing and extends along a vertical dimension of the front surface of the dispenser assembly housing adjacent to the opening at the front surface of the dispenser assembly housing. The control panel is positioned adjacent to the opening such that the control panel extends along the second height of the opening and includes at least one user input control positioned on the front surface of the housing adjacent to the opening at the front surface of the housing. The ratio defined by dividing the second height by the first height is greater than a ratio defined by dividing the second width by the first width.

In yet another aspect, a refrigerator includes a refrigerator door including a front surface configured to define a door surface hole having a first height and a first width and a dispenser positioned at the front surface of the refrigerator and at least partially accommodated by the door surface hole. The dispenser includes a housing configured to define a dispensing cavity in at least a portion of the housing. The dispensing cavity has an opening at a front surface of the housing to enable insertion of a container into the dispensing cavity and has a second height and a second width at the opening of the dispensing cavity. The second width is less than the first width. A control panel extends along a vertical dimension of the front surface of the housing adjacent the opening at the front surface of the housing. The control panel includes at least one user input control and a display positioned along the vertical dimension of the front surface of the housing adjacent the opening at the front surface of the housing. A ratio defined by dividing the second height by the first height is greater than a ratio defined by dividing the second width by the first width.

DETAILED DESCRIPTION

Figure 1:
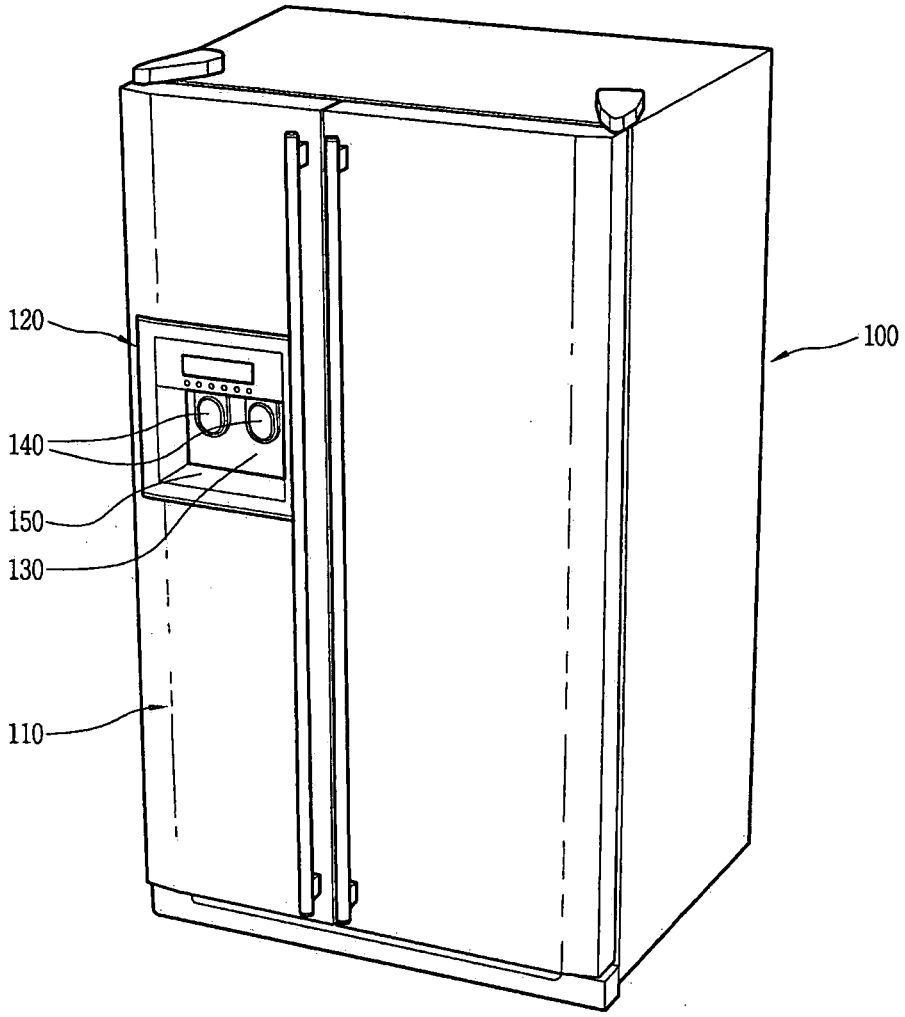
FIGURE 1 Prior Art
FIGS. 1-5 illustrate examples of a refrigerator that includes a dispenser.
Figure 2:
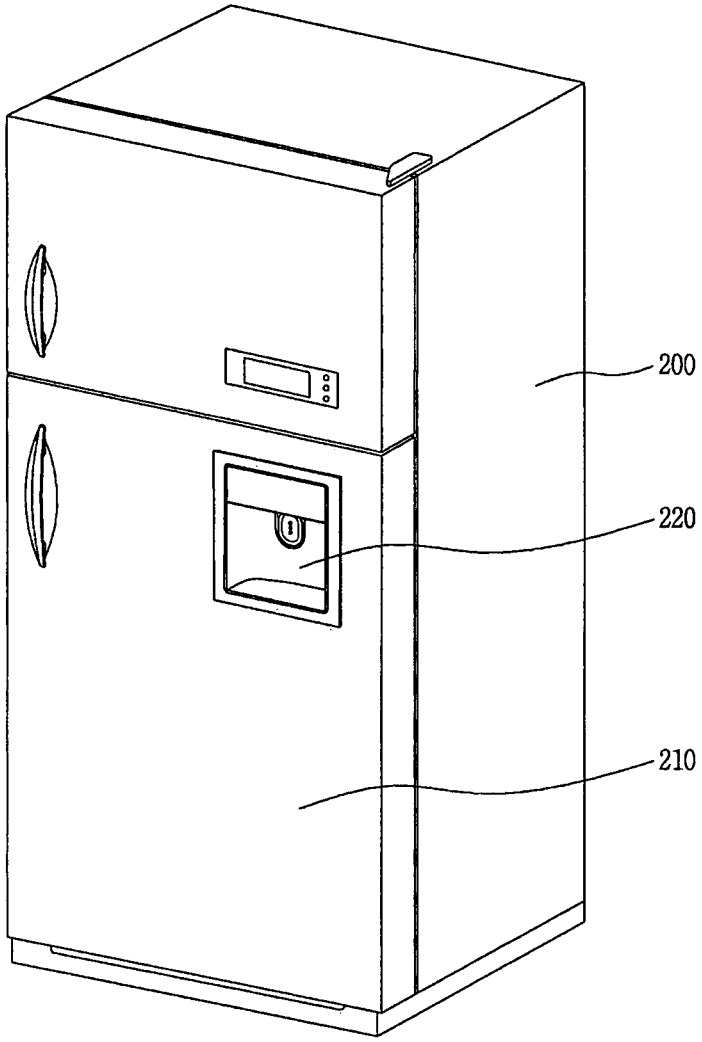
FIGURE 2 Prior Art
Figure 3:
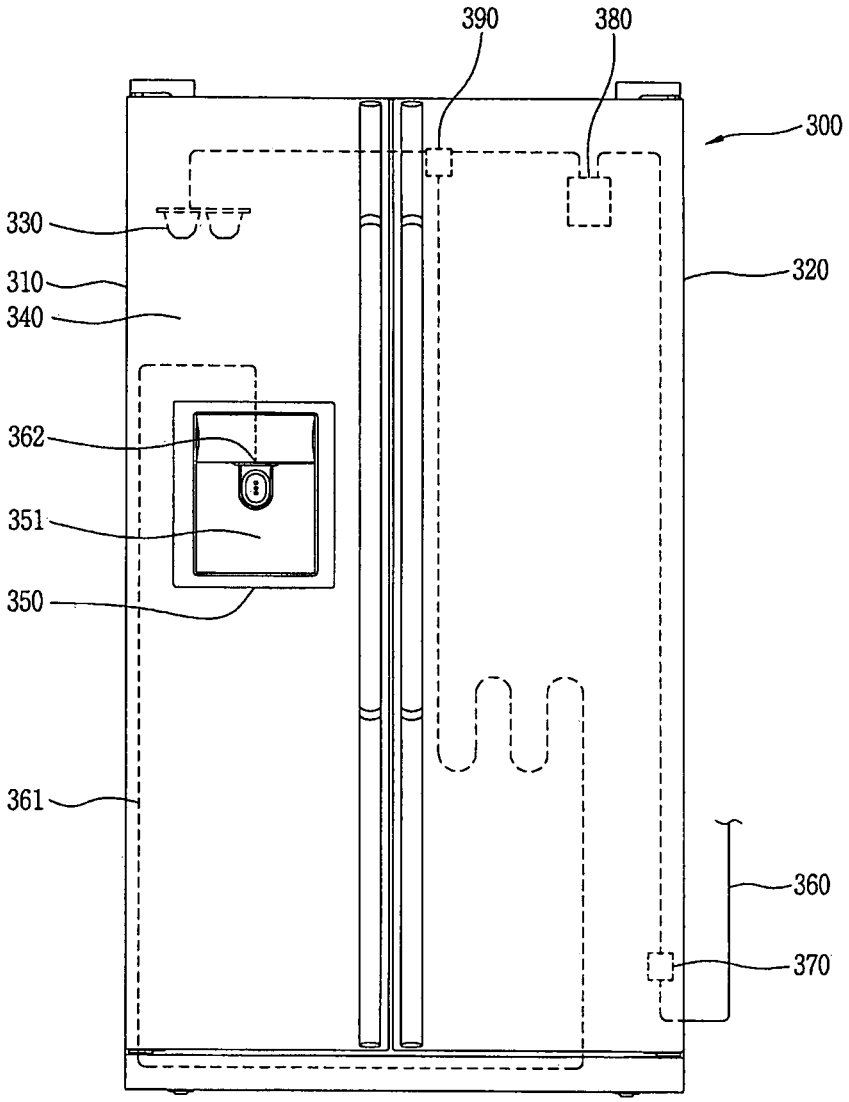
FIGURE 3 Prior Art
Figure 4:
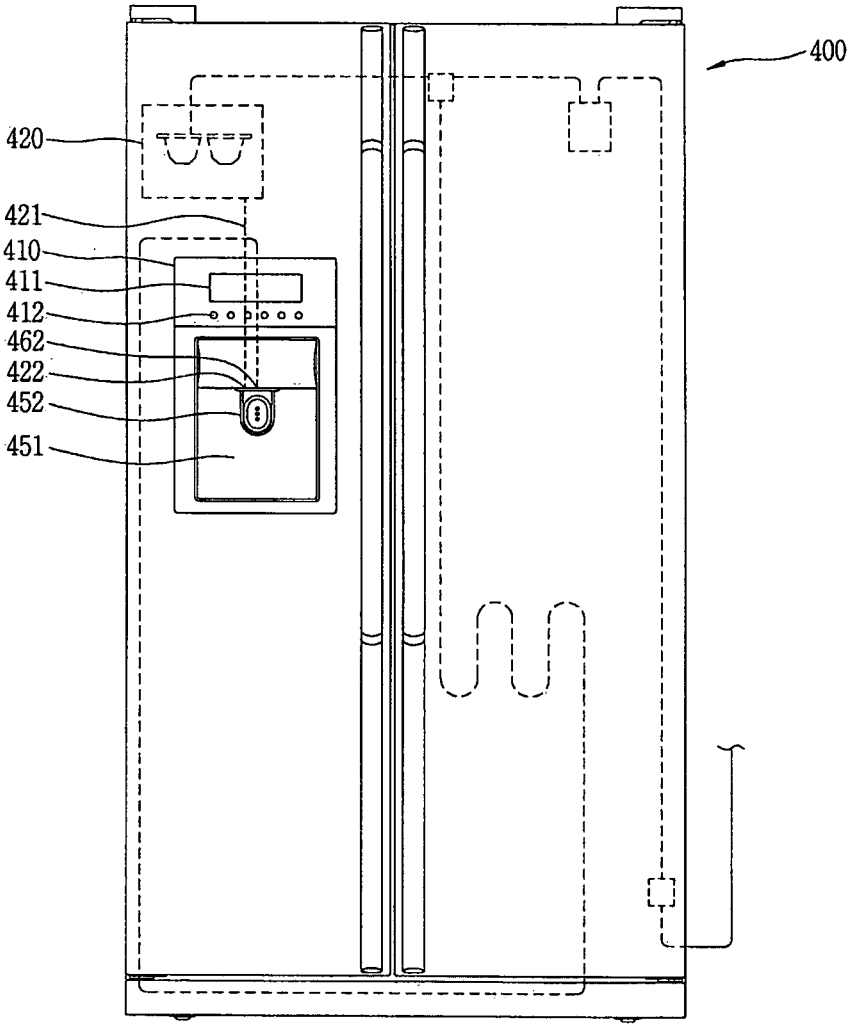
FIGURE 4 Prior Art
Figure 5:
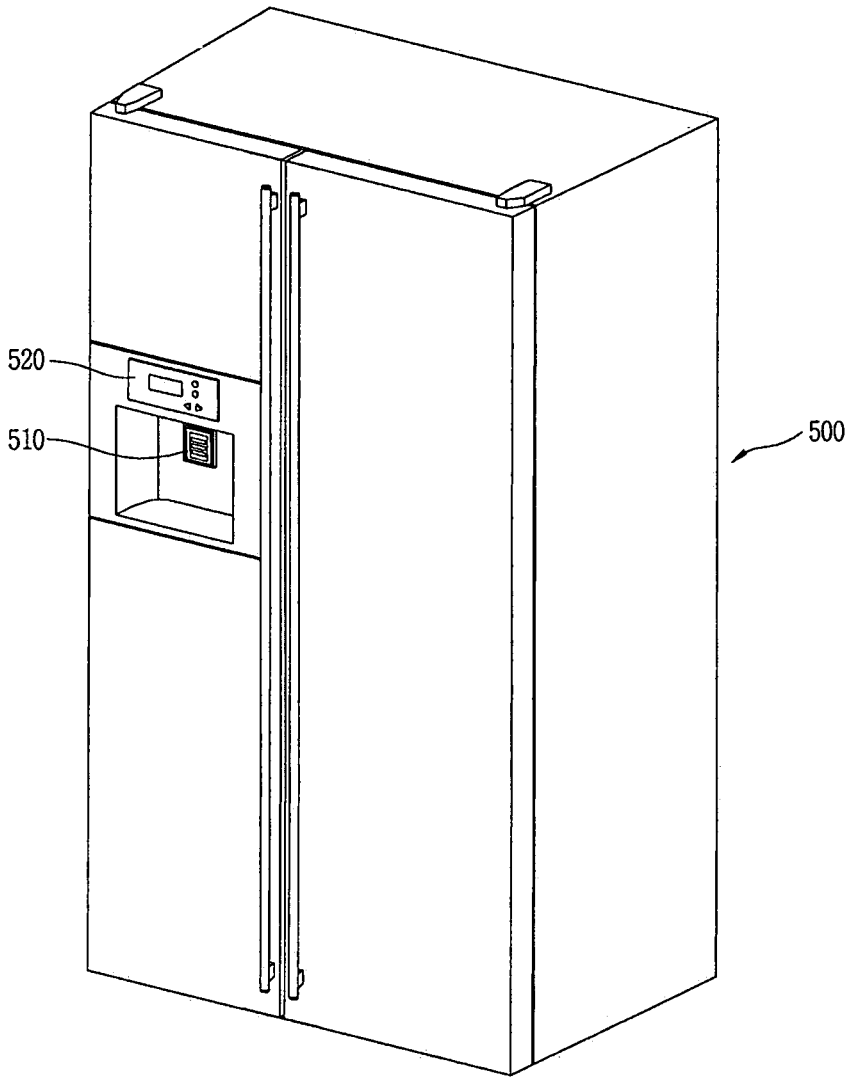
FIGURE 5 Prior Art
Figure 6:
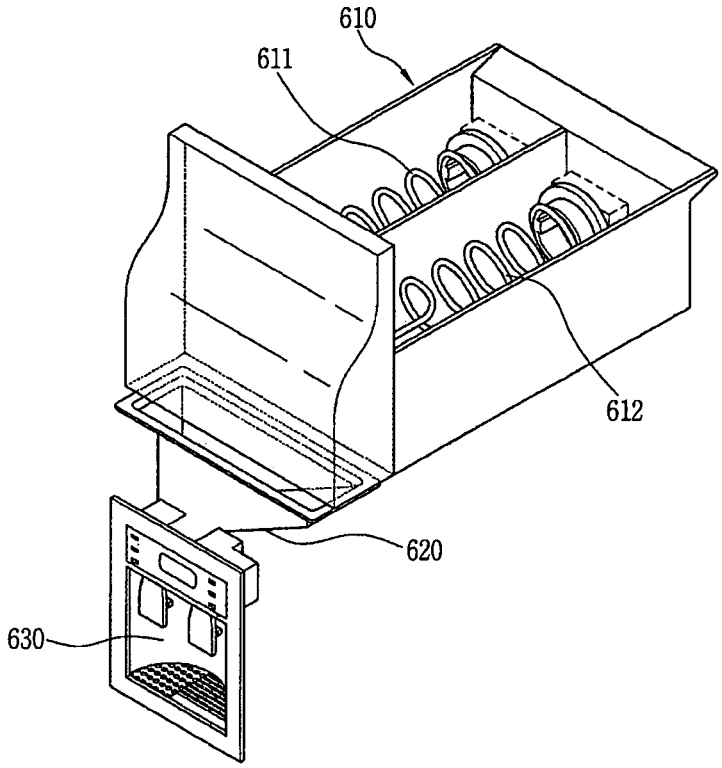
FIGURE 6 Prior Art
FIGS. 6 and 7 are views illustrating an example of a dispenser structure for a refrigerator.
Figure 7:
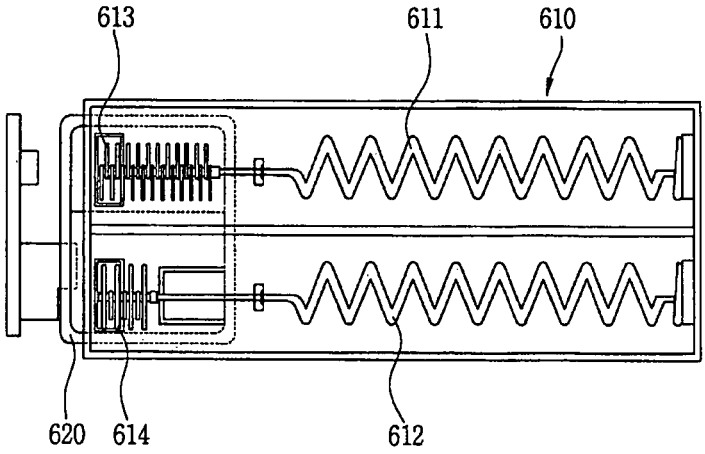
Figure 8:
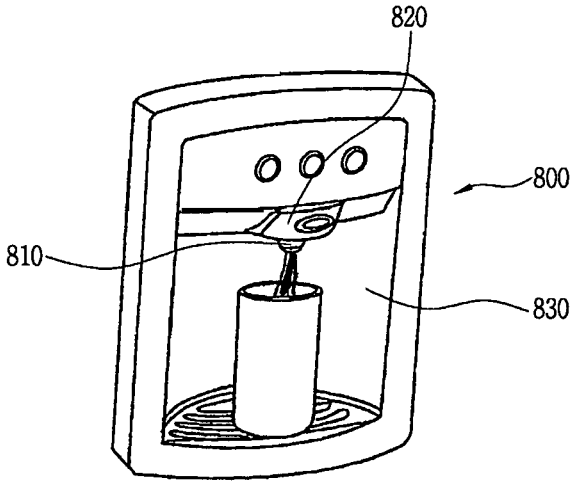
FIGURE 8 Prior Art
FIGS. 8 and 9 are perspective views illustrating an example of a dispenser for a refrigerator.
Figure 9:
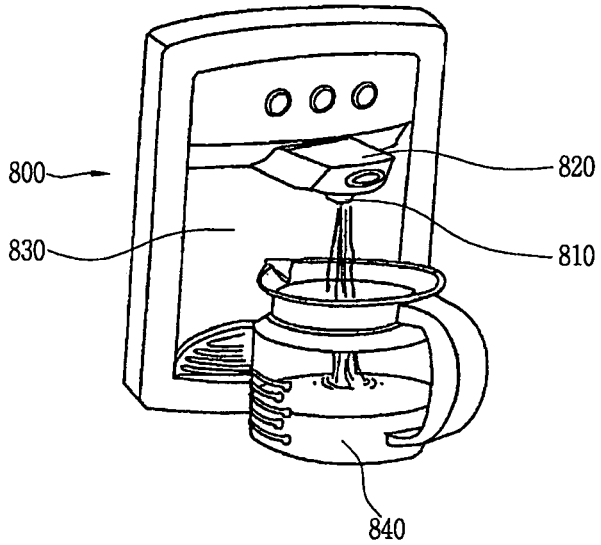
FIGURE 9 Prior Art
Figure 10:
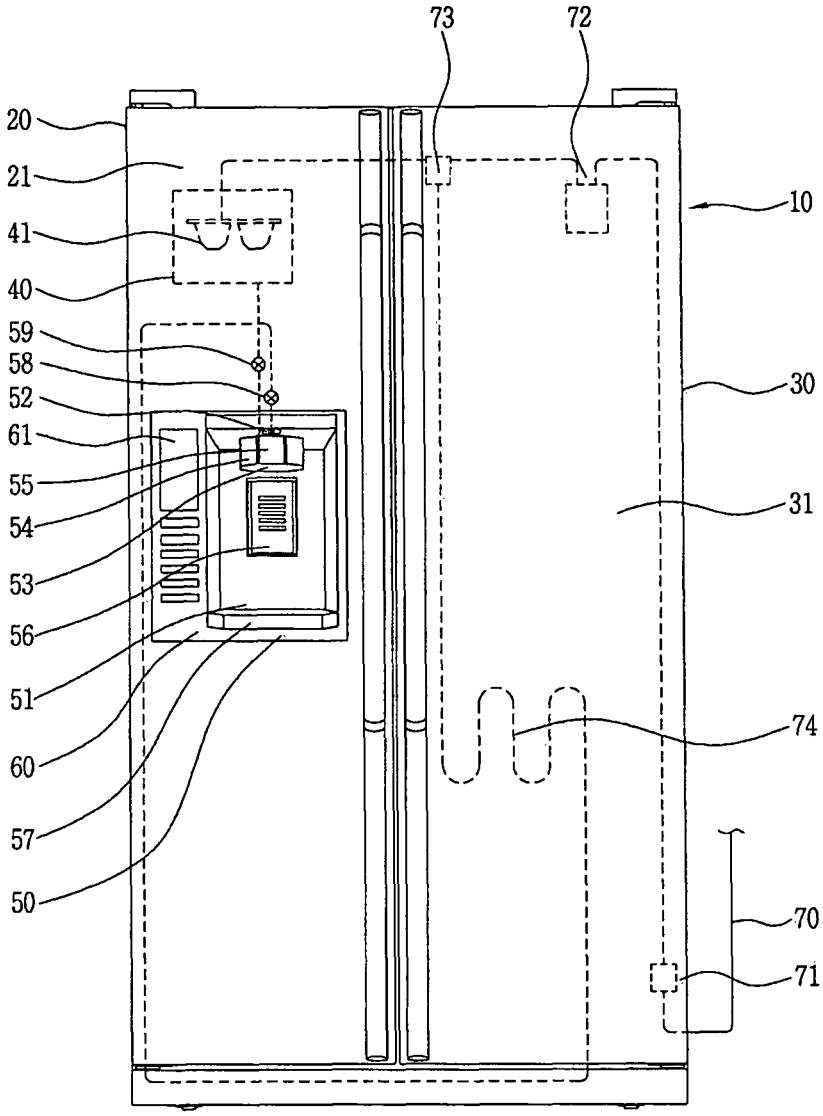
FIG. 10 is a front view illustrating an example of a refrigerator that includes a dispenser.

FIG. 10 is a front view illustrating an example of a refrigerator that includes a dispenser. The refrigerator 10 includes a freezing chamber 20, a freezing chamber door 21 configured to open and close the freezing chamber 20, a refrigerating chamber 30, and a refrigerating chamber door 31 configured to open and close the refrigerating chamber 30. An ice maker 40 is installed in the freezing chamber 20 and configured to make ice. A dispenser 50 is installed on the freezing chamber door 21 and an operation panel 60 configured to control operation of the refrigerator 10 is installed on the freezing chamber door 21 at one side of the dispenser 50.

The refrigerator 10 includes a flow path 70 configured to supply water from an external water supply source (not shown) to the refrigerator 10. A first valve 71, a filter 72, a second valve 73, and a heat exchange unit 74 are provided along on the flow path 70. The first valve 71 is configured to control water supply to the refrigerator 10, the filter 72 filters water, and the second valve 73 controls water supply to the ice maker 40 and the heat exchange unit 74. The heat exchange unit 74 is configured to cool water and is positioned at the side of the refrigerator corresponding to the refrigerating chamber 30. Ice made by the ice maker 40 and water cooled by the heat exchange unit 74 may be discharged through the dispenser 50. Although described above as being positioned at the side of the refrigerator corresponding to the refrigerating chamber 30, the heat exchange unit 74 may be positioned in any part of the refrigerator 10. In some implementations, the ice maker 40 may include only an ice tray 41. In other implementations, the ice maker 40 may include an ice bank (e.g., an ice storage bin) (not shown), an ice transfer unit (not shown) configured to automatically transfer ice from the bank to the dispenser 50, and a breaking mechanism (e.g., a cutter) (not shown) configured to break, cut, or crush ice produced by the ice maker 40. In implementations in which the ice maker 40 includes only the ice tray 41, the user may have to supply ice to an ice bank (not shown) connected to the dispenser 50 to facilitate dispensing of the ice. In implementations that include a breaking mechanism, crushed ice or cubed ice may be provided to the dispenser 50.

The dispenser 50 includes a dispenser cavity 51 which is a concave space formed in a housing of the dispenser 50. The structure defining the dispenser cavity 51 may extend into (or through) the door of the freezing chamber 21. An outlet 52 configured to discharge liquid water is positioned at a top surface of the structure defining the dispenser cavity 51, an outlet 53 configured to discharge ice is positioned behind the outlet 52, and a housing 54 surrounding the outlet 53 extends into the dispenser cavity 51 from the top surface of the structure defining the dispenser cavity. A button type switch 55 is provided on a surface of the housing 54 and is configured to control dispensing of water through the outlet 52. The button type switch 55 may be attached to the housing 54 using a mechanical fastener or may be an integrally formed portion of the housing 54. A pad type switch 56 for discharging ice is provided on a rear surface of the structure defining the dispenser cavity 51. A support 57 is provided at a bottom surface of the structure defining of the dispenser cavity 51. Valves 58 and 59 are provided on flow paths leading to the outlets 52 and 53, respectively, and are configured to control discharge of water and ice from the outlets 52 and 53. In some implementations, in the length (height) direction of the refrigerator 10, the outlet 52, the switch 55, the outlet 53 and the switch 56 are positioned in descending order with respect to the ice maker 40. In other words, the switch 56 is positioned lower (e.g., a greater distance from the ice maker) than the outlet 53, the switch 55, and the outlet 52, the outlet 53 is positioned lower (e.g., a greater distance from the ice maker) than the switch 55 and the outlet 52, and the switch 55 is positioned lower (e.g., a greater distance from the ice maker) than the outlet 52. By positioning the outlet 53 configured to discharge ice lower than the switch 55 configured to control dispensing of water through the outlet 52, a container may be prevented from receiving ice from the outlet 53 when a deepest surface of the container is being used to actuate the switch 55 to control dispensing of water into the container.

In some implementations, in the depth direction of the refrigerator 10, the outlet 52, the switch 55, the outlet 53 and the switch 56 are positioned in serial order in a direction extending from the front surface of the refrigerator to the back surface of the structure defining the dispenser cavity 51. In other words, the outlet 52 is positioned further from the back surface of the structure defining the dispenser cavity 51 than the switch 55, the outlet 53, and the switch 56, the switch 55 is positioned further from the back surface of the structure defining the dispenser cavity 51 than the outlet 53 and the switch 56, and the outlet 53 is positioned further from the back surface of the structure defining the dispenser cavity 51 than the switch 56. The switch 56 may be positioned on the back surface of the structure defining the dispenser cavity 51. Each of the outlet 52, the switch 55, the outlet 53 and the switch 56 may or may not be positioned within the dispenser cavity 51.

Figure 11:
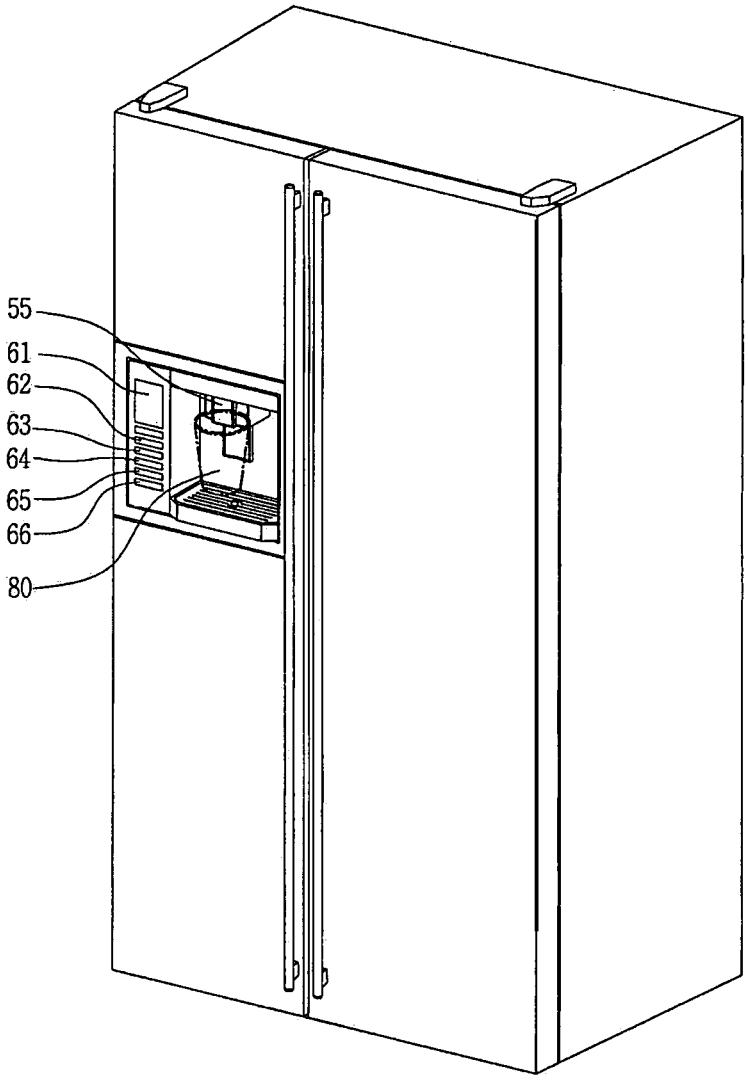
FIGS. 11 and 12 are perspective views illustrating a refrigerator that includes a dispenser.
Figure 12:
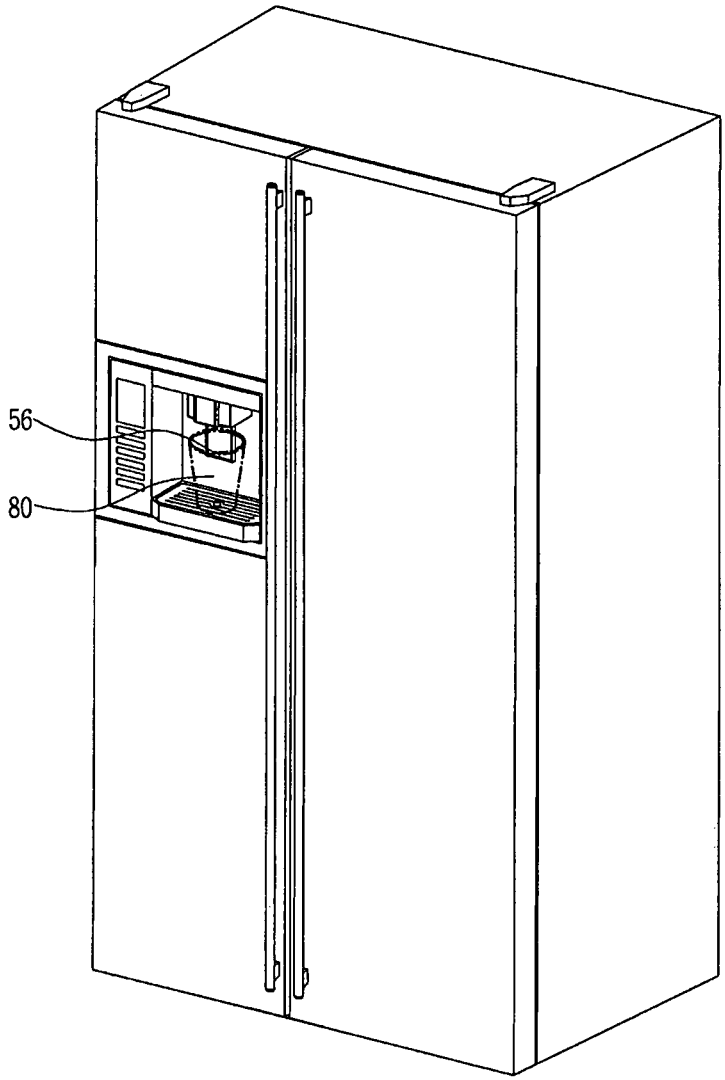

FIGS. 11 and 12 are perspective views illustrating a refrigerator that includes a dispenser. The refrigerator dispenser in the example shown in FIGS. 11 and 12 includes a configuration in which the outlet 52, the switch 55, the outlet 53 and the switch 56 are positioned in serial order in a direction extending from the front surface of the refrigerator to the back surface of the structure defining the dispenser cavity 51. As shown in FIG. 11, a user is able to receive water through the outlet 52 by pressing the switch 55 with a cup 80 (instead of actuating an input control provided on the operation panel 60 and bringing the cup 80 to the switch 56). Accordingly, a user may be able to receive water in a container by inserting the container a relatively shallow distance into the dispenser cavity 51. As shown in FIG. 12, the user may be able to receive ice through the outlet 53 by pressing the switch 56 with the cup 80. Accordingly, a user may be able to receive ice in a container by inserting the container a relatively deep distance into the dispenser cavity 51. In some examples, a container may be sized such that the container may be able to penetrate the dispenser cavity 51 far enough to actuate the switch 55 to receive water into the container, but unable to penetrate the dispenser cavity 51 far enough to actuate the switch 56 to receive ice into the container. The user may be able to receive water by using the switch 55, and then receive ice by using the switch 56. In some implementations, the user is able to receive water, ice, or water and ice without actuating an input control on the operation panel 60. In some examples, the structure prevents a user from receiving ice into a container when the user presses the deepest surface of the container in the cavity against the switch 55 because, in this position, the container is positioned entirely in front of the outlet 53.

In some implementations, the outlet 52 may extend into the dispenser cavity 51 instead of being positioned at (or above) the top surface of the structure defining the dispenser cavity 51. In some examples, the outlet 53 may be configured to discharge water in addition to ice. Each of the switches 55 and 56 may receive contact from a user by the cup 80 in a mechanical manner, convert the mechanical contact into an electrical signal, and transmit the electrical signal to a control unit (not shown) of the refrigerator 10. The switches 55 and 56 may be any type of switch configured to be actuated by a press or presence of a user or an object. For example, the switches 55 and 56 may be mechanical switches, buttons, or levers. In addition, a connection structure of the ice maker 40, the heat exchange unit 74, and the dispenser 50 may be modified and/or changed such that ice and/or water may be discharged through the outlet 53 and crushed ice may be discharged through the outlet 52.

As shown in the example illustrated in FIG. 11, the operation panel 60 includes a display 61 configured to render a user interface to display the state or status of the refrigerator 10 and various buttons 62 configured to receive user input to control operation of the refrigerator 10. For example, the buttons of the operation panel 60 may include a button 63 configured to enable selection of cubed ice or crushed ice, a button 64 configured to control the dispenser 50 to discharge water through the outlet 52, a button 65 configured to discharge ice through the outlet 53, and a button 66 configured to enable selection of one of water, cubed ice, or crushed ice to be discharged through the outlet 53. One button may be configured to perform the above functions. For example, a single button may be configured to perform a function related to controlling operation of the refrigerator 10 based on information rendered on the display 61. The operation panel 60 may extend along a horizontal dimension of the dispenser 50 and may be positioned above or below the dispenser 50 or the dispenser cavity 51. The operation panel 60 may extend along an entire horizontal dimension of the front surface of the dispenser 50 and only partially along a vertical dimension of the front surface of the dispenser 50. As shown in FIGS. 10-12, the operation panel 60 extends along a vertical dimension of the dispenser 50 and may be positioned at one side of the dispenser 50 adjacent to the dispenser cavity 51. The operational panel 60 may extend along an entire vertical dimension of the front surface of the dispenser 50 and only partially along a horizontal dimension of the front surface of the dispenser 50.

In some implementations, the dispenser 50 may be accommodated in the freezing chamber door 21 by a hole formed in the surface of the freezing chamber door 21. A sizing ratio of the hole formed in the surface of the freezing chamber door 21 may be defined as a height of the hole divided by a width of the hole and a sizing ratio of the dispenser cavity 51 may be defined as a height of an opening of the dispenser cavity 51 divided by a width of the opening of the dispenser cavity 51. In some implementations, the sizing ratio of the hole in the surface of the freezing chamber door 21 may be different than the sizing ratio of the dispenser cavity 51. For example, in implementations in which the operation panel 60 extends along a horizontal dimension of the dispenser 50, the sizing ratio of the door surface hole may be greater than the sizing ratio of the dispenser cavity 51. In these implementations, a ratio defined by dividing the height of the dispenser cavity 51 with the height of the door surface hole is less than a ratio defined by dividing the width of the dispenser cavity 51 with the width of the door surface hole. In implementations in which the operation panel 60 extends along a vertical dimension of the dispenser 50, the sizing ratio of the door surface hole may be less than the sizing ratio of the dispenser cavity 51. In these implementations, a ratio defined by dividing the height of the dispenser cavity 51 with the height of the door surface hole is greater than a ratio defined by dividing the width of the dispenser cavity 51 with the width of the door surface hole.

In some implementations, the configuration in which a sizing ratio of the door surface hole is different than a sizing ratio of the dispenser cavity 51 may result in improved features. For example, this configuration may be able to cope with a spatial limit of the freezing chamber door 21 caused by the existence of the ice maker 40, the existence of the two outlets 52 and 53 formed in the length direction, the need for the height expansion of the dispenser cavity 51, the existence of a storing chamber formed at the lower portion of the freezing chamber 20 (e.g., a French door refrigerator including a bottom mount freezer compartment), the expansion necessity of the dispenser cavity 51 by the housing 54 and the switch 55, and/or other arrangements. By providing the operation panel 60 above or adjacent to the dispenser cavity 51, contact of the operational panel 60 by spilled water or ice may be limited.

Figure 13:
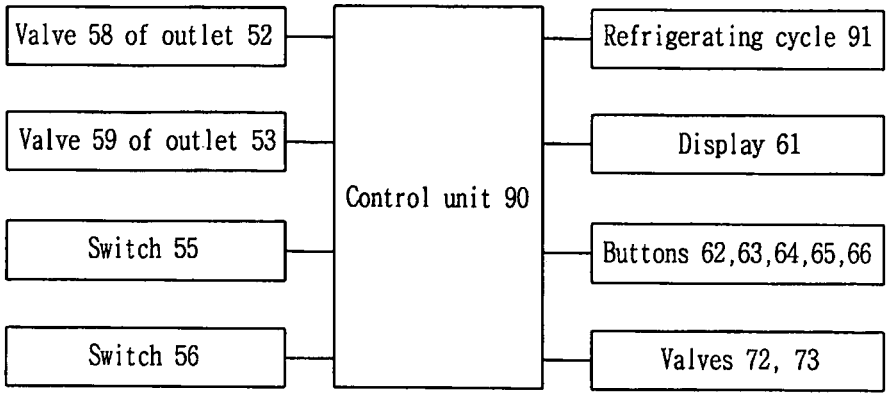
FIG. 13 is a block diagram illustrating an example of a control arrangement configured to operate a refrigerator.

FIG. 13 is a block diagram illustrating an example of a control arrangement configured to operate a refrigerator. A control unit 90 is configured to receive inputs from the buttons 62 to 66, control a refrigerating cycle 91, and control the display 61 to render a display of the operation state of the refrigerator 10. The control unit 90 is configured to control a temperature of water cooled by the heat exchange unit 74 and production of ice by the ice maker 40 by controlling a first valve 71 and a second valve 72. In response to receiving an input from the switch 55, the control unit 90 may be configured to inspire opening of the valve 58 associated with the outlet 52 to supply (e.g., dispense) water through the outlet 52. In response to receiving an input from the switch 56, the control unit 90 may be configured to initiate opening of the valve 59 associated with the outlet 53 to supply (e.g., dispense) ice through the outlet 53.

The control unit 90 may be configured to handle concurrent actuation of the switch 55 and the switch 56. In some implementations, the control unit 90 may be configured to inspire simultaneous dispensing of water and ice in response to concurrent actuation of the switch 55 and the switch 56 (e.g., inspire opening of both the valve 58 and the valve 59). In other implementations, the control unit 90 may be configured to prevent dispensing both water and ice in response to concurrent actuation of the switch 55 and the switch 56. For example, the control unit 90 may be configured to prevent dispensing of water and prevent dispensing of ice in response to concurrent actuation of the switch 55 and the switch 56 (e.g., prevent opening of both the valve 58 and the valve 59). In another example, the control unit 90 may be configured to prevent dispensing of water and allow dispensing of ice in response to concurrent actuation of the switch 55 and the switch 56 (e.g., prevent opening of the valve 58 and inspire opening of the valve 59). In a further example, the control unit 90 may be configured to allow dispensing of water and prevent dispensing of ice in response to concurrent actuation of the switch 55 and the switch 56 (e.g., inspire opening of the valve 58 and prevent opening of the valve 59).

In some implementations, the control unit 90 may be configured to temporarily prevent dispensing both water and ice in response to concurrent actuation of the switch 55 and the switch 56 and allow dispensing in response to a condition being met. For example, the control unit 90 may be configured to prevent dispensing of water and prevent dispensing of ice in response to concurrent actuation of the switch 55 and the switch 56 for a threshold period of time (e.g., prevent opening of both the valve 58 and the valve 59 for the threshold period of time) and to allow simultaneous dispensing of water and ice in response to concurrent actuation of the switch 55 and the switch 56 being maintained for more than the threshold period of time (e.g., inspire opening of both the valve 58 and the valve 59 in response to a user pressing (e.g., pressing and holding) both the switch 55 and the switch 56 for more than the threshold period of time). In another example, the control unit 90 may be configured to allow dispensing of ice and prevent dispensing of water for a threshold period of time in response to concurrent actuation of the switch 55 and the switch 56 (e.g., prevent opening of the valve 58 and inspire opening of the valve 59 for the threshold period of time) and to allow dispensing of water in response to actuation of the switch 55 being maintained for more than the threshold period of time (e.g., inspire opening of the valve 58 in response to a user pressing (e.g., pressing and holding) the switch 55 for more than the threshold period of time). In a further example, the control unit 90 may be configured to allow dispensing of water and prevent dispensing of ice for a threshold period of time in response to concurrent actuation of the switch 55 and the switch 56 (e.g., inspire opening of the valve 58 and prevent opening of the valve 59 for the threshold period of time) and to allow dispensing of ice in response to actuation of the switch 56 being maintained for more than the threshold period of time (e.g., inspire opening of the valve 59 in response to a user pressing (e.g., pressing and holding) the switch 56 for more than the threshold period of time). The control unit 90 may be configured to always prevent dispensing of water for a threshold period of time in response to actuation of the switch 55 regardless of the actuation of the switch 56 (e.g., prevent opening of the valve 58 for the threshold period of time) and to allow dispensing of water in response to actuation of the switch 55 being maintained for more than the threshold period of time (e.g., inspire opening of the valve 58 in response to a user pressing (e.g., pressing and holding) the switch 55 for more than the threshold period of time).

In some implementations, the control unit 90 may be configured to determine which of the switch 55 and the switch 56 was first actuated in response to concurrent actuation of the switch 55 and the switch 56. In these implementations, the control unit 90 may be configured to control dispensing of water and ice based on the determination. For example, the control unit 90 may be configured to prevent dispensing of ice and allow dispensing of water responsive to concurrent actuation of the switch 55 and the switch 56 conditioned on determining that the switch 55 was first actuated. In another example, the control unit 90 may be configured to allow dispensing of ice and prevent dispensing of water responsive to concurrent actuation of the switch 55 and the switch 56 conditioned on determining that the switch 56 was first actuated.

Figure 14:
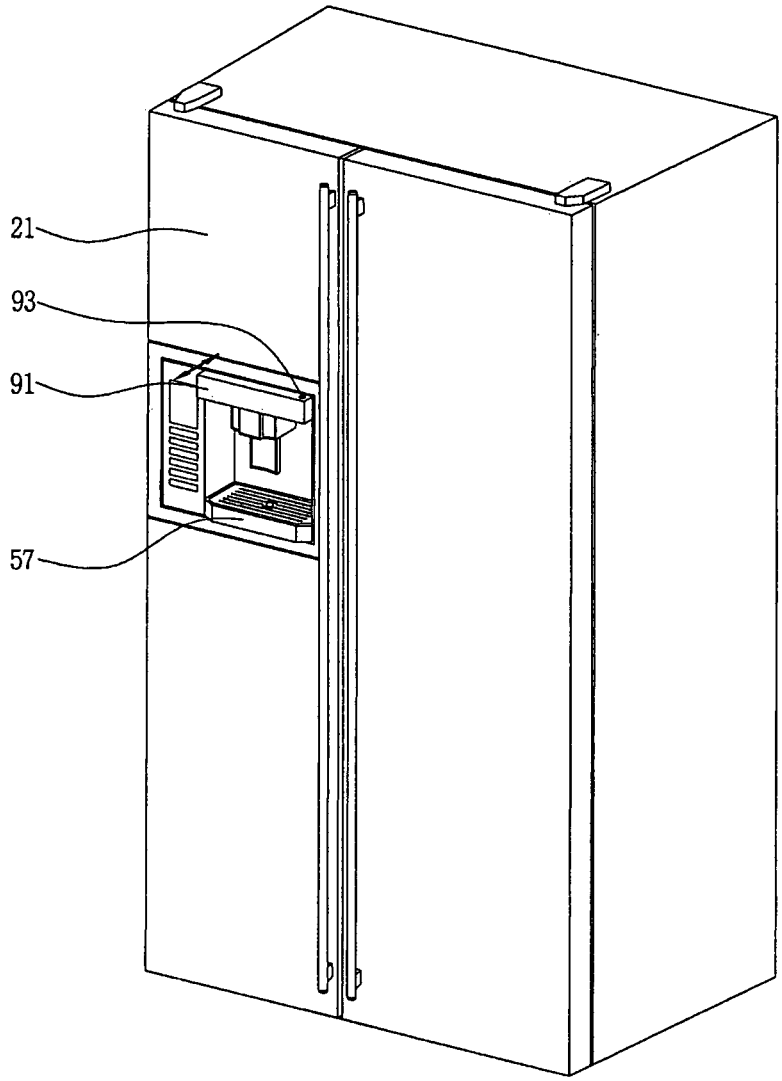
FIG. 14 is a perspective view illustrating an example of a refrigerator that includes a dispenser with a housing including a water supply outlet in an extended position.

In implementations in which the control unit 90 prevents or temporarily prevents simultaneous dispensing of ice and water, problems related to spilling and inadvertent actuation of a dispensing control may be improved. FIG. 14 is a perspective view illustrating an example of a refrigerator that includes a dispenser with a housing including a water supply outlet in an extended position. A housing 91 for the outlet 52 may be slidably formed and configured to extend out from the front of the freezing chamber door 21 from a withdrawn position to an extended position. The outlet may be attached to (e.g., integrally formed with, attached via mechanical fastening or otherwise attached) the housing 91 such that as the housing 91 moves, the outlet 52 also moves to the front of (or outside of) the freezing chamber door 21.

Figure 15:
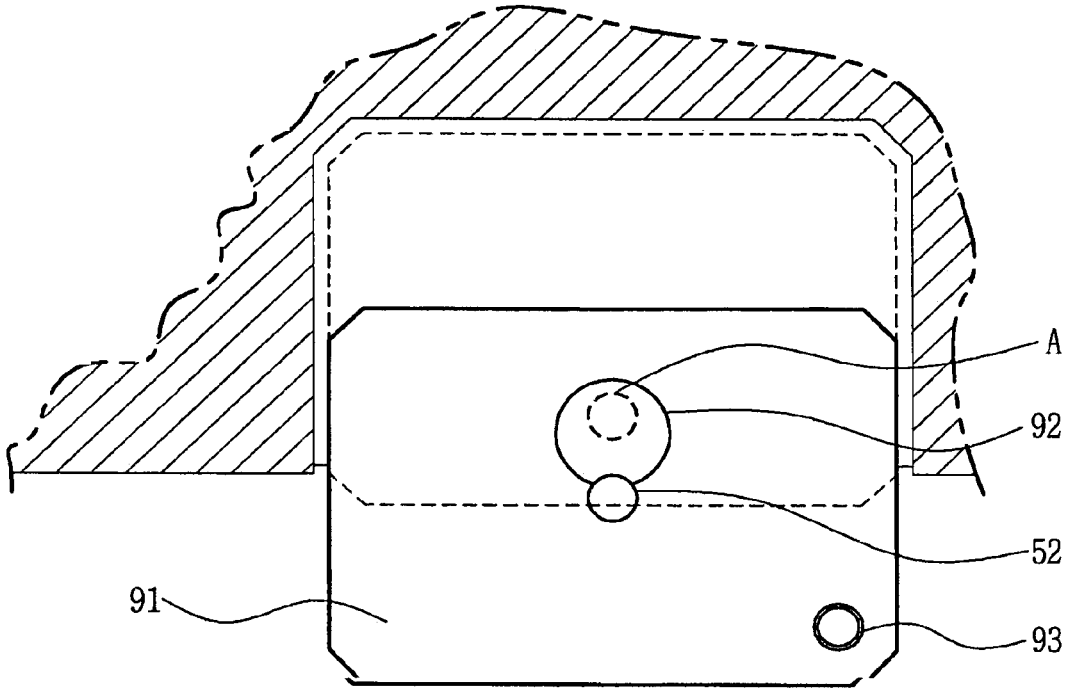
FIG. 15 is a top view illustrating an example of a dispenser with a housing including a water supply outlet in an extended position.

FIG. 15 is a top view illustrating an example of a dispenser with a housing including a water supply outlet in an extended position (e.g., the dispenser shown included in the refrigerator shown in FIG. 14). In implementations in which the outlet 52 is configured to extend to the front of (or outside of) the freezing chamber door 21, water may be supplied to a container having a larger width than the dispenser cavity 51. In these implementations, in order to supply water from the flow path 70 (refer to FIG. 10) to the outlet 52, a channel 92 may be formed at the rear side of the outlet 52 to include the original position A of the outlet 52. When the outlet 52 moves to the front, water may be supplied from the flow path 70 to the channel 92 and the channel 92 guides the water to the outlet 52. In one example, the flow path 70 and the outlet 52 may be connected by a pleated hose. The housing 91 may be configured to automatically or manually move. For example, the housing 91 may be configured to, responsive to user input, be automatically moved by a motor, a spring, or another type of mechanical drive mechanism. In some implementations, the housing 91 is configured to move the outlet 52 and the housing 54, the switch 55, the outlet 53, and the switch 56 remain stationary in response to movement of the housing 91. In other implementations, the housing 91 and the housing 54 may be attached (e.g., integrally formed with, attached via mechanical fastening or otherwise attached) with each other, so that the outlet 52, the housing 54, the switch 55, and the outlet 53 are configured to move together. In further implementations, the outlet 53 and the housing 54 may be disconnected, so that the outlet 52, the housing 54, and the switch 55 are configured to move together and the outlet 53 remains stationary. The housing 54 may be part of the housing 91 such that the switch 55 positioned on the housing 54 maintains its relative position to the outlet 52 when the housing 91 moves from the withdrawn position to the extended position. A button 93 may be provided on the upper surface of the housing 91. The button 93 may be configured to inspire dispensing of water through the outlet 52 responsive to actuation of the button 93. The button 93 may be configured such that it inspires dispensing of water through the outlet 52 responsive to actuation of the button 93 only when the housing 91 is in the extended position. For example, the button 93 may be configured such that the button 93 is hidden when the housing 91 is in the withdrawn or the control unit 91 may be configured to prevent dispensing of water through the outlet 52 in response to actuation of the button 93 when the housing 91 is in the extended position.

In some implementations, the switch 55 and the button 93 may be configured to inspire dispensing of water through the outlet 52 responsive to actuation of either the switch 55 or the button 93. In other implementations, only the button 93 is configured to inspire dispensing of water through the outlet 52 responsive to actuation of the button 93 when the housing 91 is in the extended position and only the switch 55 is configured to inspire dispensing of water through the outlet 52 responsive to actuation of the switch 55 when the housing 91 is in the withdrawn position. The switch 55 may be configured to inspire dispensing of water through the outlet 52 responsive to actuation of the switch 55 when the housing 91 is in the extended position only when the housing 54 and the switch 55 connected to the housing 91 and configured to move when the housing 91 moves from the withdrawn position to the extended position.

Figure 16:
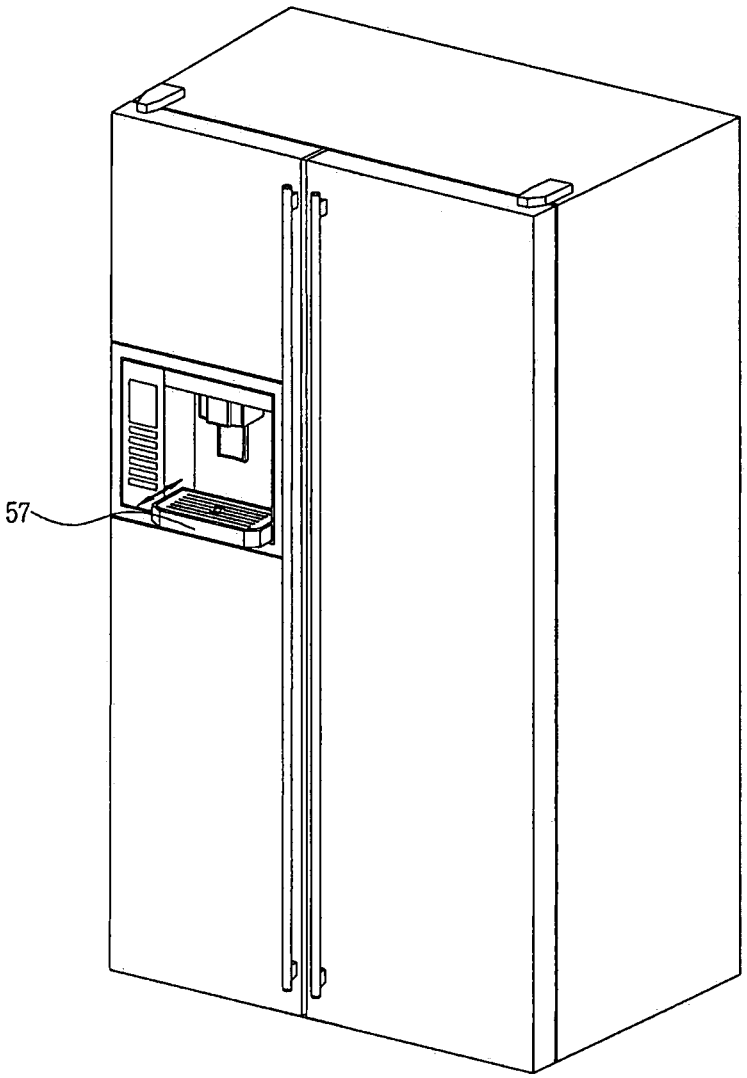
FIG. 16 is a perspective view illustrating an example of a refrigerator that includes a dispenser with a container support in an extended position.

FIG. 16 is a perspective view illustrating an example of a refrigerator that includes a dispenser with a container support in an extended position. In some implementations, the container support 57 may be slidably formed and configured to extend out to the front of (or outside of) the front of the freezing chamber door 21 (refer to FIG. 10). In these implementations, the space of the dispenser cavity 51 may be expanded and a larger container may be stably supported. In some examples, the outlet 52 may be positioned at the front portion of the dispenser cavity 51. In these examples, the outlet 52 may be configured to dispense water into a container that is too large to completely enter the dispenser cavity 51 and supported by the container support 57 in the extended position.

Figure 17:
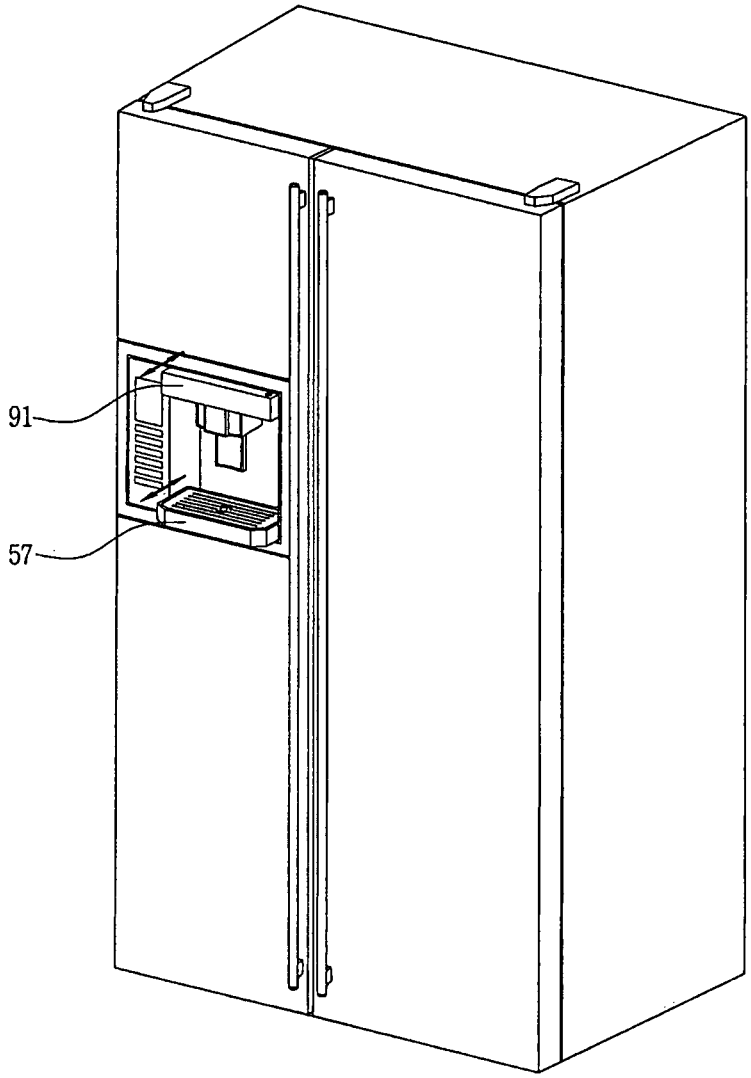
FIG. 17 is a perspective view illustrating an example of a refrigerator that includes a dispenser with a housing including a water supply outlet and a container support.

FIG. 17 is a perspective view illustrating an example of a refrigerator that includes a dispenser with a housing including a water supply outlet and a container support. The housing 91 for the outlet 52 and the support 57 may be slidably formed and configured to extend out to the front of (or outside of) the freezing chamber door 21 (refer to FIG. 10). In this example, the space of the dispenser cavity 51 may be expanded and a container may be placed on the support 57 and supplied with water by pressing the button 93 (refer to FIG. 14). In some implementations, the outlet 53 is movable. In these implementations, the button 93 and the button 66 may be connected in a manner such that pressing the button 93 may cause dispensing of ice through the outlet 53 when the outlet 53 is in an extended position.

Figure 18:
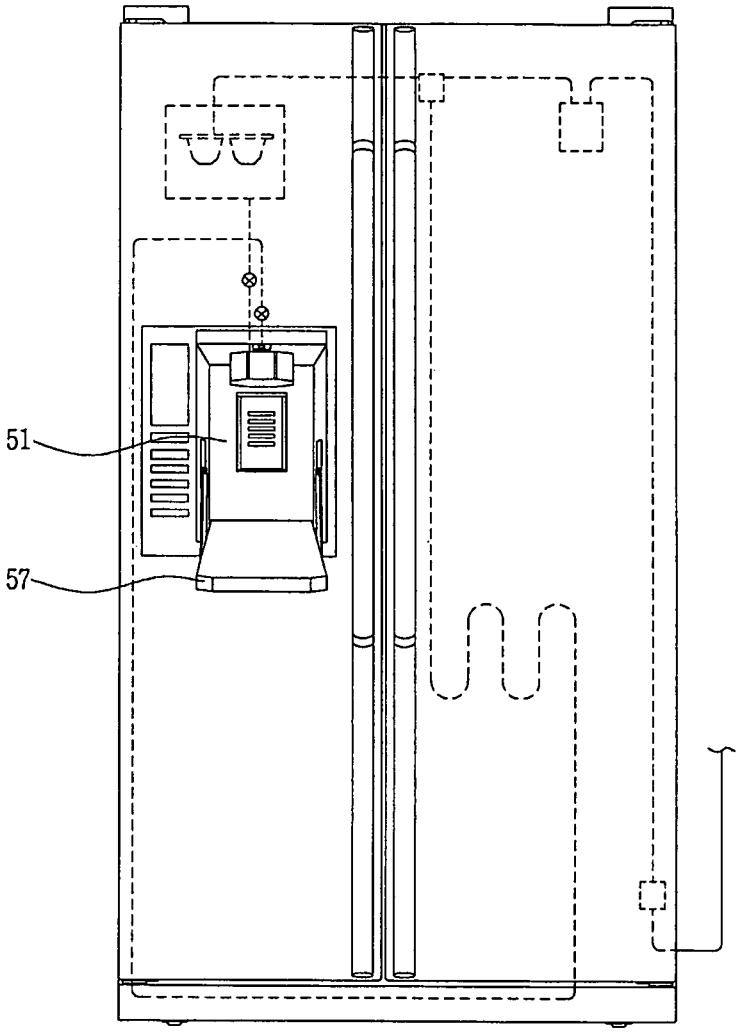
FIGS. 18-20 are front views illustrating examples of refrigerators that include dispensers.

FIG. 18 is a front view illustrating an example of a refrigerator that includes a dispenser. In some implementations, the support 57 may be configured to open and close the dispenser cavity 51. In these implementations, the depth of the dispenser cavity 51 may be reduced, the space of the dispenser cavity 51 may be expanded, the external appearance of the freezing chamber door may be improved, and children may be prevented from unnecessarily using the dispenser 50.

Figure 19:
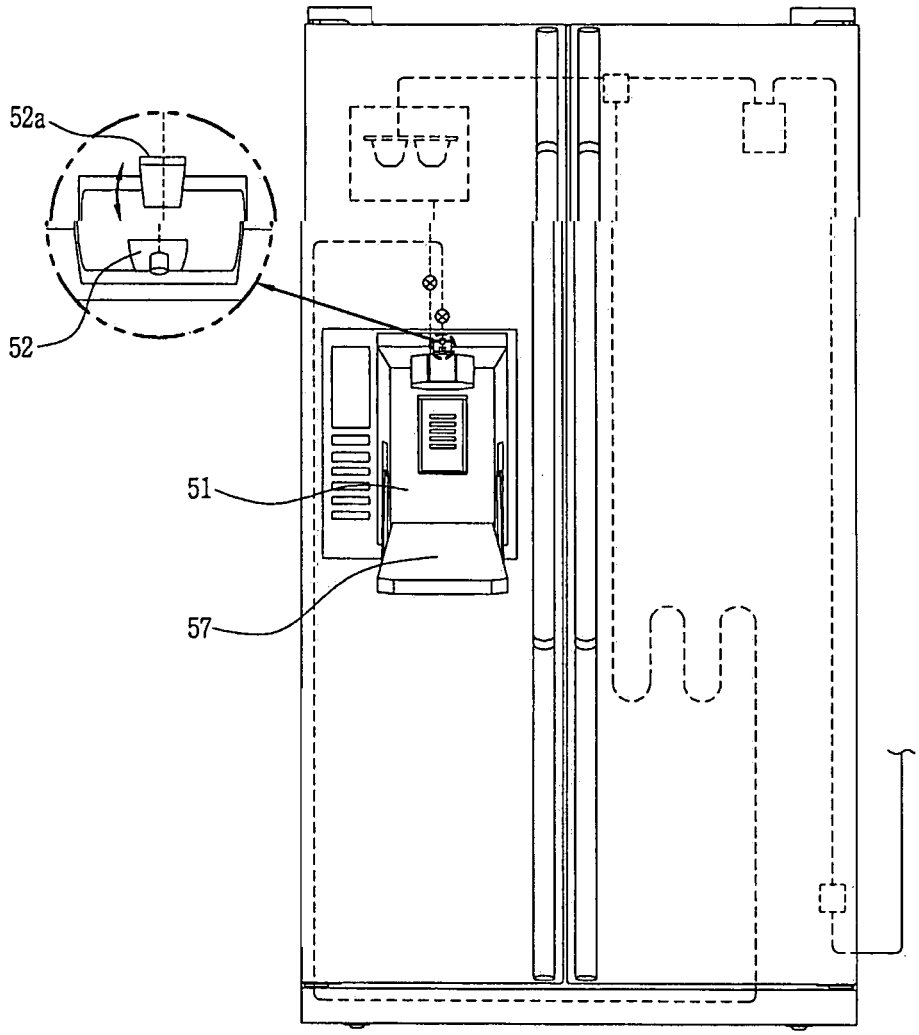

FIG. 19 is a front view illustrating an example of a refrigerator that includes a dispenser. A water discharge direction of the outlet 52 may be controlled by a handle 52*a*. When a container, which is too large to completely enter the dispenser cavity 51, is supported by a user's hand or placed on the container support 57 in the extended position, the container may be filled with water using the handle 52*a* to turn the outlet 52 in a direction pointing out from the freezing chamber door 21.

Figure 20:
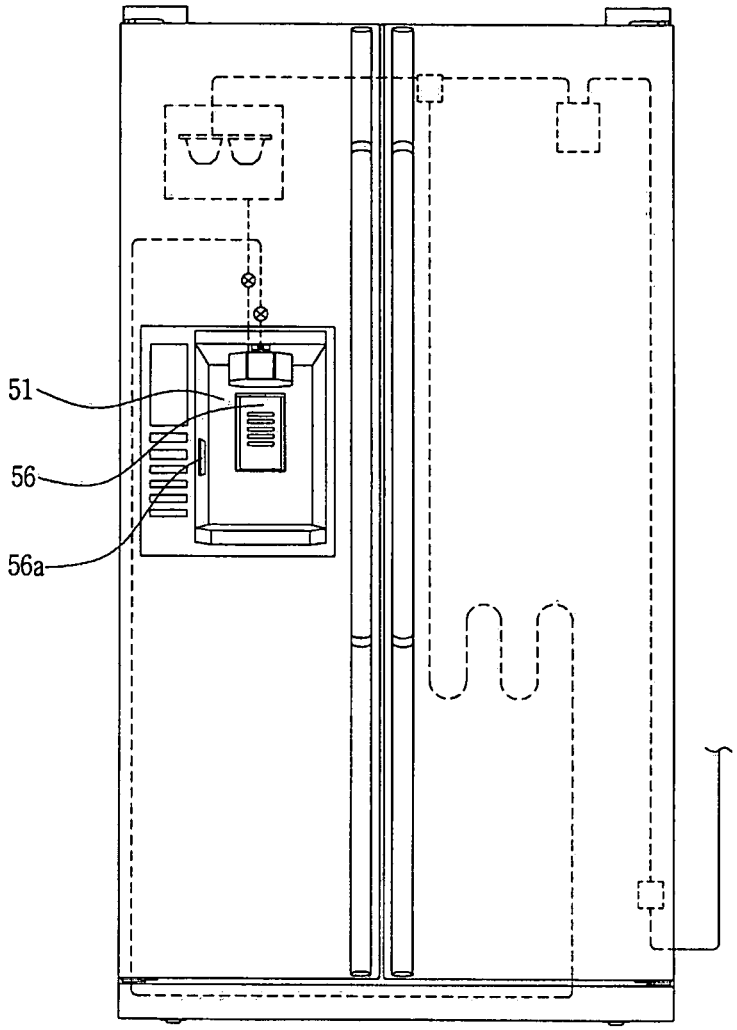

FIG. 20 is a front view illustrating an example of a refrigerator that includes a dispenser. A switch 56*a* may be provided at the side of the dispenser cavity 51. In implementations in which water and ice may be supplied through the outlet 53, the user may dispense ice by pressing the switch 56 with a cup using one hand and may dispense water by pressing the switch 56*a* using the other hand. It is also possible to omit the switch 56 and configured the switch 56*a* to control discharge ice. If the user presses the switch 56 by the user's hand or if the user places a cup on the support 57 and presses the switch 56, the ice discharged through the outlet 53 may touch the user hand. In implementations in which the switch 56 is omitted and the switch 56*a* is provided, the user may press switch 56*a* without the ice discharged through the outlet 53 touching the user's hand.

Figure 21:
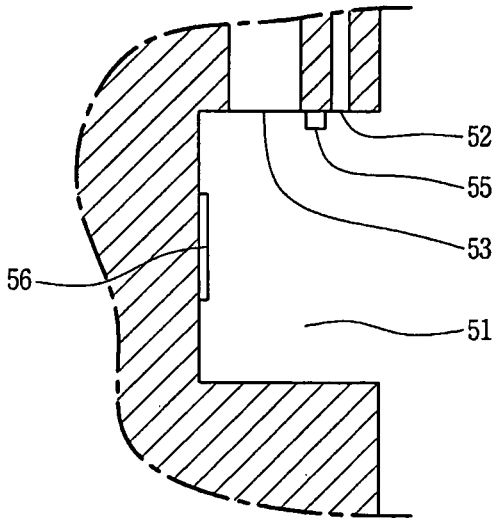
FIGS. 21 and 22 are side views illustrating examples of a dispenser structure.

FIG. 21 is a side view illustrating an example of a dispenser structure. In this example, the switch 55 is formed between the outlet 52 and the outlet 53 at a structure defining the upper surface of the dispenser cavity 51. The switch 56 is positioned on a back surface of the structure defining the dispenser cavity 51.

Figure 22:
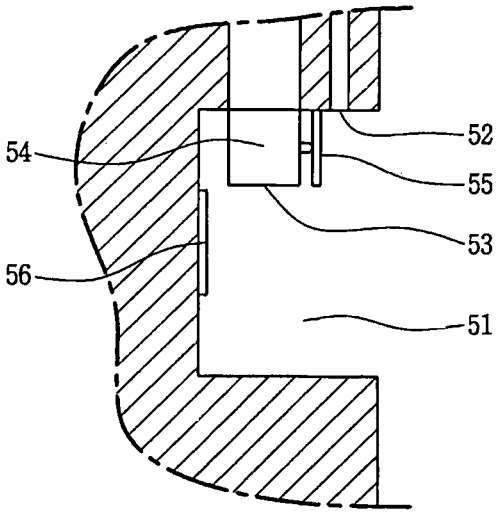

FIG. 22 is a side view illustrating an example of a dispenser structure. In this example, the switch 55 is a lever type switch and is provided between the outlet 52 and the outlet 53 on a front surface of the housing 54. The housing 54 may be configured to guide ice discharged through the outlet 53 and support the switch 55 used to control dispensing of liquid through the outlet 52. The switch 56 is positioned on a back surface of the structure defining the dispenser cavity 51.

What is claimed is:

1. A refrigerator, comprising:

a chamber configured to store food;

a refrigerator door configured to open and close at least a portion of the chamber;

a dispenser mounted on the refrigerator door and defining a dispenser cavity in the refrigerator door;

an ice dispensing outlet located within the dispenser cavity and configured to dispense ice;

a water dispensing outlet located within the dispenser cavity and configured to dispense liquid water, the water dispensing outlet being positioned in front of the ice dispensing outlet such that the water dispensing outlet is further from a back surface of the dispenser cavity than the ice dispensing outlet;

a water switch disposed within the dispenser cavity and configured to control the dispenser to dispense liquid water through the water dispensing outlet;

an ice switch disposed on the back surface of the dispenser cavity and configured to control the dispenser to dispense ice through the ice dispensing outlet, the ice switch being separate from the water switch and being the only dispensing switch disposed on the back surface of the dispenser cavity;

a control panel located on the refrigerator door, outside of the dispenser cavity, and at a lateral side of the dispenser cavity; and at least one control button that is configured to control the dispenser and that is located in the control panel.

2. The refrigerator of claim 1, wherein the control panel has a display.

3. The refrigerator of claim 2 wherein the display is configured to render a user interface indicating operational status of the refrigerator dispenser.

4. The refrigerator of claim 3 wherein the control panel includes multiple input buttons and at least one of the buttons receives input to inspire performance of a function based on the user interface rendered on the display of the control panel.

5. The refrigerator of claim 3, wherein the at least one control button located at the lateral side of the dispenser cavity includes at least one control button configured to control the dispenser to dispense at least one of ice and liquid water.

6. The refrigerator of claim 3, wherein the at least one control button located at the lateral side of the dispenser cavity includes at least one control button configured to enable selection of the dispenser to dispense liquid water, cubed ice, or crushed ice.

7. The refrigerator of claim 1 wherein the control panel extends along a front surface of the dispenser such that the dispenser cavity is positioned adjacent to the control panel.

8. The refrigerator of claim 1, wherein the control panel includes a liquid dispensing switch configured to receive input to inspire dispensing of liquid water through the water dispensing outlet.

9. The refrigerator of claim 8 wherein both the liquid dispensing switch and the water switch are configured to receive input to inspire dispensing of liquid water through the water dispensing outlet.

10. The refrigerator of claim 1, wherein the control panel includes an ice dispensing switch configured to receive input to inspire dispensing of ice through the ice dispensing outlet.

11. The refrigerator of claim 10 wherein both the ice dispensing switch and the ice switch are configured to receive input to inspire dispensing of ice through the ice dispensing outlet.

12. The refrigerator of claim 1, wherein the control panel includes an ice selection switch configured to receive input to select whether ice dispensed through the ice dispensing outlet is cubed ice or crushed ice.

13. The refrigerator of claim 1, wherein the water dispensing outlet and the ice dispensing outlet are spaced apart along a length direction of the dispenser cavity that is perpendicular to a front surface of the dispenser cavity through which a container passes to enter the dispenser cavity.

14. The refrigerator of claim 1, wherein the at least one control button comprises a first button configured to control the dispenser to dispense liquid water through the water dispensing outlet and a second button configured to control the dispenser to dispense ice through the ice dispensing outlet.

15. The refrigerator of claim 1, wherein the water dispensing outlet is movable relative to the dispenser cavity.

16. The refrigerator of claim 1, wherein the water switch is disposed between the water dispensing outlet and the ice dispensing outlet and configured to control the dispenser to dispense liquid water through the water dispensing outlet.

17. The refrigerator of claim 1, further comprising:

a housing that surrounds the ice dispensing outlet and that is configured to guide ice passing through the ice dispensing outlet;

wherein the water switch is disposed on the housing and configured to control the dispenser to dispense liquid water through the water dispensing outlet.

18. The refrigerator of claim 1, further comprising:

a container support that is slidable and configured to extend out of a front of the dispenser cavity.

19. The refrigerator of claim 18, further comprising:

a dispenser housing that is slidable and configured to extend out of the front of dispenser cavity with the container support.

* * * * *